US007754988B2

(12) United States Patent
Tsao et al.

(10) Patent No.: US 7,754,988 B2
(45) Date of Patent: Jul. 13, 2010

(54) KEYPAD MODULE FOR PORTABLE ELECTRONIC DEVICES

(75) Inventors: Mei-Tsu Tsao, Tu-Cheng (TW); Ching-Sen Tsai, Tu-Cheng (TW); Ching-Chin Pun, Tu-Cheng (TW)

(73) Assignee: Chi Mei Communication Systems, Inc., Tu-Cheng, Taipei County (TW)

( * ) Notice: Subject to any disclaimer, the term of this patent is extended or adjusted under 35 U.S.C. 154(b) by 0 days.

(21) Appl. No.: 12/180,617

(22) Filed: Jul. 28, 2008

(65) Prior Publication Data

US 2009/0266694 A1 Oct. 29, 2009

(30) Foreign Application Priority Data

Apr. 25, 2008 (TW) ..... 97115440 A

(51) Int. Cl.
*H01H 13/14* (2006.01)

(52) U.S. Cl. ..... 200/341; 200/517

(58) Field of Classification Search ..... 200/511, 200/512, 516, 517, 341–345; 341/22; 345/168, 345/169

See application file for complete search history.

(56) References Cited

U.S. PATENT DOCUMENTS 5,334,667 A * 8/1994 Yamamoto et al. ..... 525/370
5,743,384 A * 4/1998 Clark ..... 200/344
6,451,143 B2 * 9/2002 Nishi ..... 156/82
6,835,906 B2 * 12/2004 Okamoto et al. ..... 200/341
7,049,530 B2 * 5/2006 Hayashizaki ..... 200/5 A
7,164,089 B2 * 1/2007 Chen ..... 200/5 A
7,348,512 B2 * 3/2008 Iohara ..... 200/341
7,358,454 B2 * 4/2008 Senzui ..... 200/341
7,361,859 B2 * 4/2008 Yoshioka et al. ..... 200/341
7,378,607 B2 * 5/2008 Koyano et al. ..... 200/341
7,485,822 B2 * 2/2009 Koyano et al. ..... 200/341

* cited by examiner

*Primary Examiner*—Michael A Friedhofer
(74) *Attorney, Agent, or Firm*—Steven M. Reiss

(57) ABSTRACT

A keypad module including at least one key (30) is described. The key (30) includes a keycap (32), a base (34), a supporting member (36), a resisting member (40) and a dome (42). The base includes a pressed portion (341) and a carrier portion (342) connected to the pressed portion. The keycap is arranged on the pressed portion. The supporting member is located on the carrier portion to support the keycap. The resisting member is located between the pressed portion and the dome to press the dome into a position electrically connected to a circuit board (44).

12 Claims, 3 Drawing Sheets

KEYPAD MODULE FOR PORTABLE ELECTRONIC DEVICES

BACKGROUND

1. Field of the Invention

The present invention relates to a keypad module, and particularly to electronic devices equipped with the keypad module.

2. Discussion of the Related Art

Recently introduced electronic devices have a variety of functions and are typically smaller, lighter, and slimmer in order to satisfy a user's demand. Accordingly, keypad modules of such electronic devices have also become smaller, lighter, and slimmer. FIG. 3 shows the structure of a key 10 of a conventional keypad module having a plurality of keys. Each key 10 includes a keycap 12, an inverted-T-shaped base 14, two supporting members 16, a resisting member 20 and a dome 22 located to correspond to a switch on a circuit board (not shown). The resisting member 20 is arranged between the dome 22 and the base 14. The base 14 is for bearing the keycap 12 arranged thereon. When the keycap 12 is pressed downward by an external force, the resisting member 20 centralizes the external force applied to the base 14 and further presses the dome 22 to contact and activate the switch on the circuit board.

However, the supporting members 16 with strong hardness are located on two opposite ends of the base 14 for supporting the keycap 12 when the key 10 is pressed by the external force. The vertical distance between the supporting members 16 and the keycap 12 defines a gap 18 for the keycap 12. Understandably, the gap 18 has to be large enough to allow the dome 22 to contact and activate the switches. In view of the above, the supporting members 16 increase overall thickness of the keys 10.

Therefore, a new keypad module with reduced thickness and weight and an electronic device equipped with the keypad module are desired in order to overcome the above-described problems.

BRIEF DESCRIPTION OF THE DRAWINGS

Many aspects of the keypad module can be better understood with reference to the following drawings. The components in the drawings are not necessarily to scale, the emphasis instead being placed upon clearly illustrating the principles of the present keypad module. Moreover, in the drawings, like reference numerals designate corresponding parts throughout the several views.

DETAILED DESCRIPTION OF THE EMBODIMENTS

Figure 1:
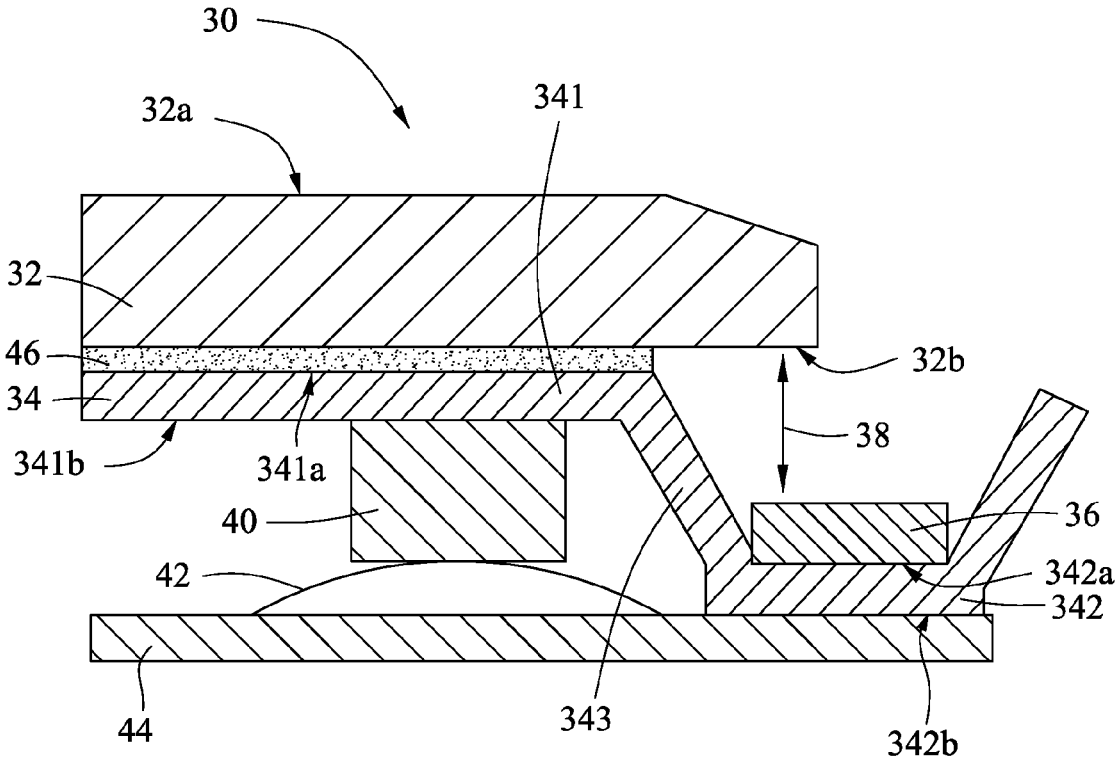
FIG. 1 is a cross-sectional view of the present keypad module according to an exemplary embodiment.
Figure 2:
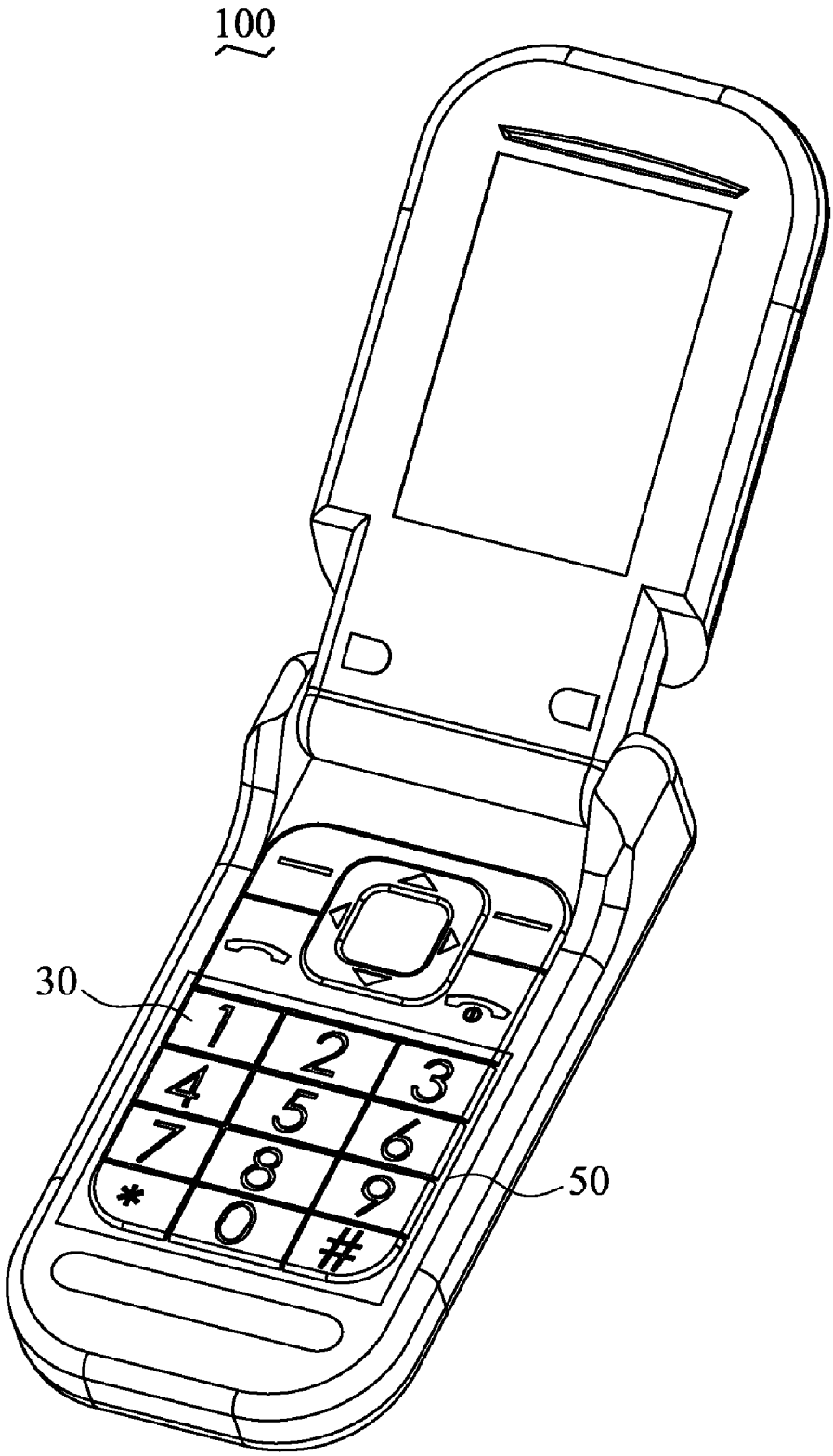
FIG. 2 is an isometric view of a portable electronic device equipped with the keypad module of FIG. 1.
Figure 3:
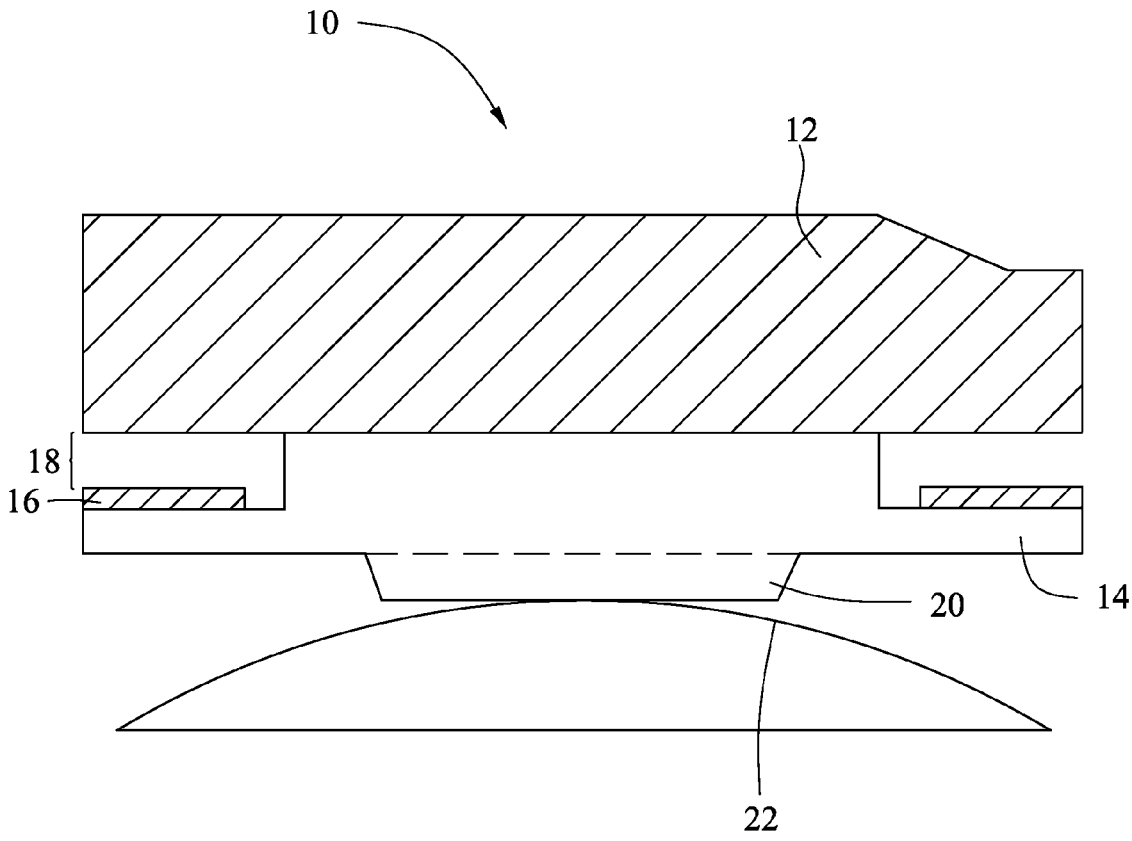
FIG. 3 is a cross-sectional view of a conventional keypad module.

FIG. 1 shows a structure of a key 30 arranged within a keypad module 50. The keypad module 50 has a plurality of keys 30 and is incorporated in a mobile phone 100 as shown in FIG. 2. The mobile phone 100 is taken here as an exemplary application for the purposes of describing details of the keypad module 50. In alternative embodiments, the mobile phone 100 can be replaced by another portable electronic device, for example a personal digital assistant (PDA).

Each of the keys 30 includes a keycap 32, a base 34, a supporting member 36, a resisting member 40, and a dome 42. The keycap 32 includes a first surface 32*a* and an opposite second surface 32*b*. The first surface 32*a* is the surface being pressed by external force. In the exemplary embodiment, the keycap 32 is substantially rectangular. In alternative embodiments, the keycap 32 may be other geometric shapes.

The base 34 includes a pressed portion 341, a carrier portion 342 and a connecting portion 343. The carrier portion 342 is connected to the pressed portion 341 by the angled connecting portion 343. The pressed portion 341 supports the keycap 32 thereon, and the carrier portion 342 is located on a circuit board 44.

The pressed portion 341 includes a first surface 341*a* and an opposite second surface 341*b*. The first surface 341*a* is located adjacent to the second surface 32*b* of the keycap 32. In the exemplary embodiment, the first surface 341*a* is attached to the second surface 32*b* of the keycap 32 by an adhesive layer 46. The carrier portion 342 includes a first surface 342*a* and a second surface 342*b* directly contacting the circuit board 44. The included angle between the connecting portion 343 and the carrier portion 342 is approximately 120 degrees. In addition, the included angle between the connecting portion 343 and the pressed portion 341 is also approximately 120 degrees.

The supporting member 36 is located on the first surface 342*a* of the carrier portion 342. A gap 38 formed between the supporting member 36 and the keycap 32 allows the keycap 32 to move upward and downward when the keycap 32 is pressed and released. The above-mentioned included angles may be adjusted to change the vertical length of the gap 38.

The resisting member 40 is located between the pressed portion 341 of the base 34 and the dome 42. A top surface of the resisting member 40 is connected to the second surface 341*b* of the pressed portion 341 by adhesive material. In alternative embodiments, the resisting member 40 may be integrally formed with the base 34. In addition, in the exemplary embodiment, the resisting member 40 is made of plastic material and substantially rectangular. In alternative embodiments, the resisting member 40 may be of other materials and geometric shapes.

The thickness of the resisting member 40 is less than the thickness of the keycap 32. Therefore, when the keycap 32 is pressed downward by an external force, the resisting member 40 centralizes the external force applied to the base 34 and presses down the dome 42.

The dome 42 is made of metallic and elastic material, i.e., stainless steel or copper. The dome 42 is located to correspond to the switches (not shown) on the circuit board 44. When the keycap 32 is pressed, the base 34 and the resisting member 40 press the dome 42 in the downward direction of arrow 38 shown in FIG. 1 to contact and activate the corresponding switches on the circuit board 44.

In view of the above, the distance between the pressed portion 341 and the carrier portion 342 is utilized to locate the supporting member 36. In this way, the vertical length of the gap 38 is not occupied by the supporting member 36 and the overall thickness of the keypad module 50 and the mobile phone 100 equipped with the keypad module 50 is decreased.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A keypad module including at least one key, the key comprising:

a keycap;

a base comprising a pressed portion, an angled connecting portion and a carrier portion, the carrier portion being connected to the pressed portion via the angled connecting portion such that a vertical distance being formed between the pressed portion and the carrier portion;

a supporting member being located on the carrier portion and at the vertical distance between the pressed portion and the carrier portion, to support the keycap;

a dome; and a resisting member being located between the pressed portion and the dome to press the dome into a position electrically connected to a circuit board.

2. The keypad module as claimed in claim 1, wherein the supporting member and the keycap are spaced from each other to form a gap for allowing the keycap to move toward the dome, when the keycap is pressed.

3. The keypad module as claimed in claim 1, wherein a first adjusted included angle is formed between pressed portion and the connecting portion.

4. The keypad module as claimed in claim 1, wherein a second adjusted included angled is formed between the connecting portion and the carrier portion.

5. The keypad module as claimed in claim 1, wherein the resisting member is attached to the base by adhesive material.

6. The keypad module as claimed in claim 1, wherein the resisting member is integrally formed with the base.

7. An electronic device having a circuit board and a keypad module, the circuit board having a plurality of switches arranged thereon, the keypad module having at least one key, the key comprising:

a keycap;

a base comprising a pressed portion, an angled connecting portion and a carrier portion, the carrier portion being connected to the pressed portion via the angled connecting portion such that a vertical distance being formed between the pressed portion and the carrier portion;

a supporting member being located on the carrier portion and at the vertical distance between the pressed portion and the carrier portion, to support the keycap;

a dome; and a resisting member being located between the pressed portion and the dome to activate the corresponding switches on the circuit board by the dome.

8. The electronic device as claimed in claim 7, wherein the supporting member and the keycap are spaced from each other to form a gap for allowing the keycap to move toward the dome, when the keycap is pressed.

9. The electronic device as claimed in claim 7, wherein a first adjusted included angle is formed between pressed portion and the connecting portion.

10. The electronic device as claimed in claim 7, wherein a second adjusted included angled is formed between the connecting portion and the carrier portion.

11. The electronic device as claimed in claim 7, wherein the resisting member is attached to the base by adhesive material.

12. The electronic device as claimed in claim 7, wherein the resisting member is integrally formed with the base.

* * * * *